US005246088A

United States Patent [19]

Imai et al.

[11] Patent Number: 5,246,088

[45] Date of Patent: Sep. 21, 1993

[54] AUTOMATIC LUBRICATING DEVICE FOR A CUTTING HEAD OF A CUTTING MACHINE

[75] Inventors: Taichi Imai; Kenji Ikoma, both of Wakayama, Japan

[73] Assignee: Shima Seiki Mfg., Ltd., Wakayama, Japan

[21] Appl. No.: 936,488

[22] Filed: Aug. 28, 1992

[30] Foreign Application Priority Data

Aug. 28, 1991 [JP] Japan ..... 3-217250

[51] Int. Cl.[5] ..... F01M 1/04; F01M 1/18; F01M 11/10

[52] U.S. Cl. ..... 184/6.5; 184/6.14; 184/29; 184/42; 184/39.1; 30/123.3; 83/169

[58] Field of Search ..... 184/6.3, 6.14, 6.5, 184/6.19, 29, 39, 42, 39.1, 6.4, 6.1; 30/123.3; 83/169, 170

[56] References Cited

U.S. PATENT DOCUMENTS

| | | | |
|---|---|---|---|
| 1,000,791 | 8/1911 | Erikson | 184/39 |
| 2,045,737 | 6/1936 | Vancil et al. | 184/6.3 |
| 2,209,938 | 7/1940 | Shaver | 184/6.14 |
| 2,425,281 | 8/1947 | Hoelscher | 184/6.3 |
| 3,960,244 | 1/1976 | Clark | 184/6.14 |
| 4,199,950 | 4/1980 | Hakanson et al. | 184/6.3 |

*Primary Examiner*—Thomas E. Denion

*Attorney, Agent, or Firm*—Edwin E. Greigg; Ronald E. Greigg

[57] ABSTRACT

An automatic lubricating device for a cutting head of a cutting machine. The lubricating device is assembled within the cutting head and includes a pressure cylinder for forcing lubricating oil through a passage to a sump from which the lubricating oil is forced through a jet onto the cutter device mechanism. The lubricating device can be operated just prior to cutting or just after a cutting procedure with the cutting blade in an up or a down position.

4 Claims, 4 Drawing Sheets

AUTOMATIC LUBRICATING DEVICE FOR A CUTTING HEAD OF A CUTTING MACHINE

BACKGROUND OF THE INVENTION

This invention relates to an automatic lubricating device for a cutting head of a cutting machine which is used for cutting a pile of soft sheets such as cloth.

Conventionally, lubricating to a drive mechanism of a cutting blade of a cutting head has been done by hand operation periodically.

However, lubrication by hand has a difficulty in maintenance of the operation and further, there was a problem that a proper time for lubrication tended to be lost in order to keep a good efficiency of operation.

This invention has been achieved to fully solve the problem and its object is to provide an automatic lubricating device for a cutting head of a cutting machine which enables automatic lubrication to the drive mechanism of a cutting blade without lowering efficiency in operation.

SUMMARY OF THE INVENTION

In order to achieve the above object, an automatic lubricating device for a cutting head of a cutting machine proposed in the present invention comprises a cutting head, which in operation is lifted up and down freely by a cylinder for an up and down movement, containing a cutting blade drive mechanism. The cutting head comprises an oil sump provided inside the cutting head and below the cutting blade drive mechanism, a lubricating cylinder is operated coincident with an operation of the cylinder for an up and down movement, a pump is driven by the lubricating cylinder, and a nozzle through which lubricating oil in the oil sump is jetted out by a pressure of the pump to the cutting blade drive mechanism. In the lubricating device, the lubricating oil is jetted out by a pressure of the pump to the cutting blade drive mechanism either when the cutting head is lifted up and when the cutting head is moved downwardly. The used lubricating oil drops down in the oil sump thereby oil lubricating to the cutting blade drive mechanism is conducted automatically when a cutting operation occurs.

DETAILED DESCRIPTION OF THE PREFERRED EMBODIMENT

An embodiment of an automatic lubricating device for a cutting head of a cutting machine is described with drawings in the following paragraphs.

Figure 2:
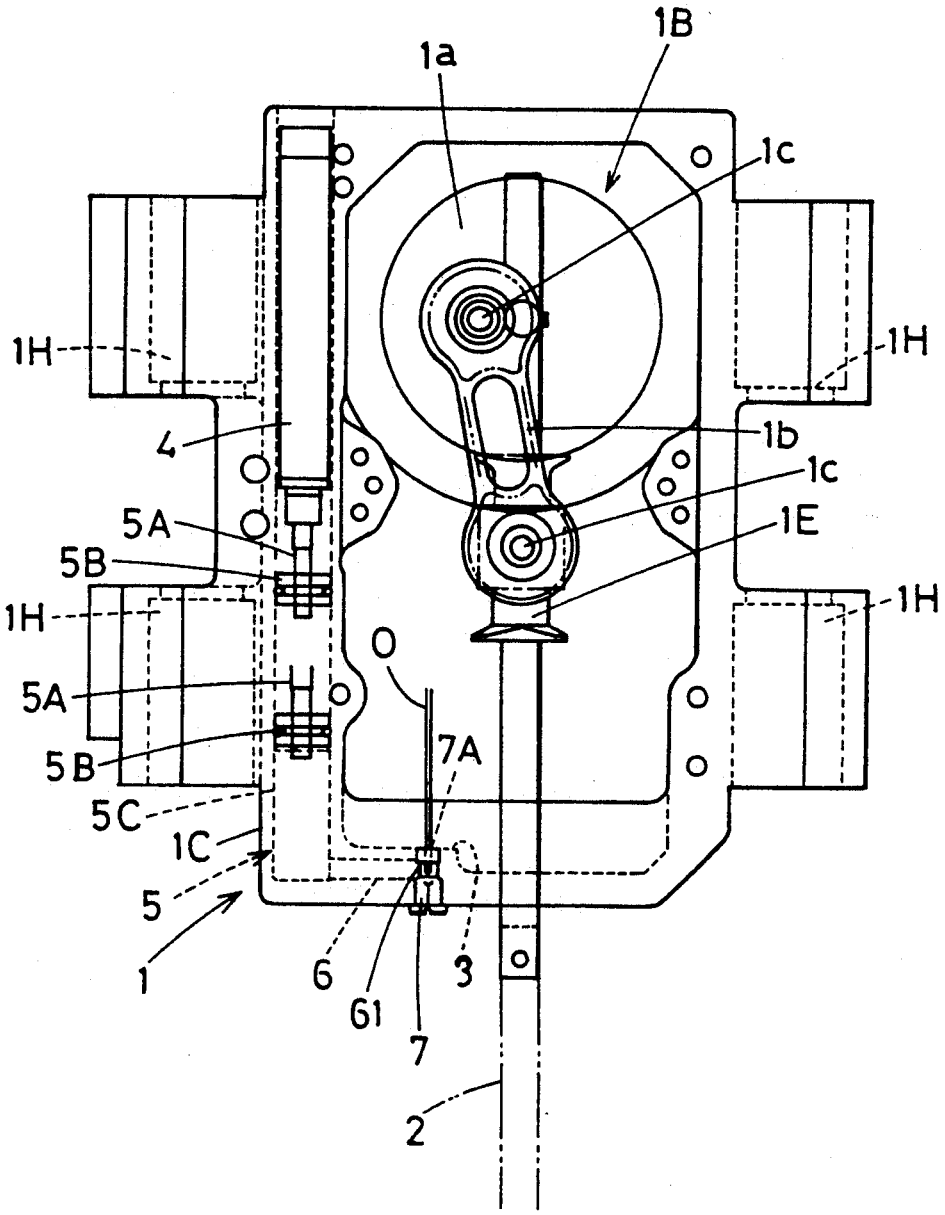
FIG. 2 is a cross-section of a front view of a cutting head in the present invention.
Figure 3:
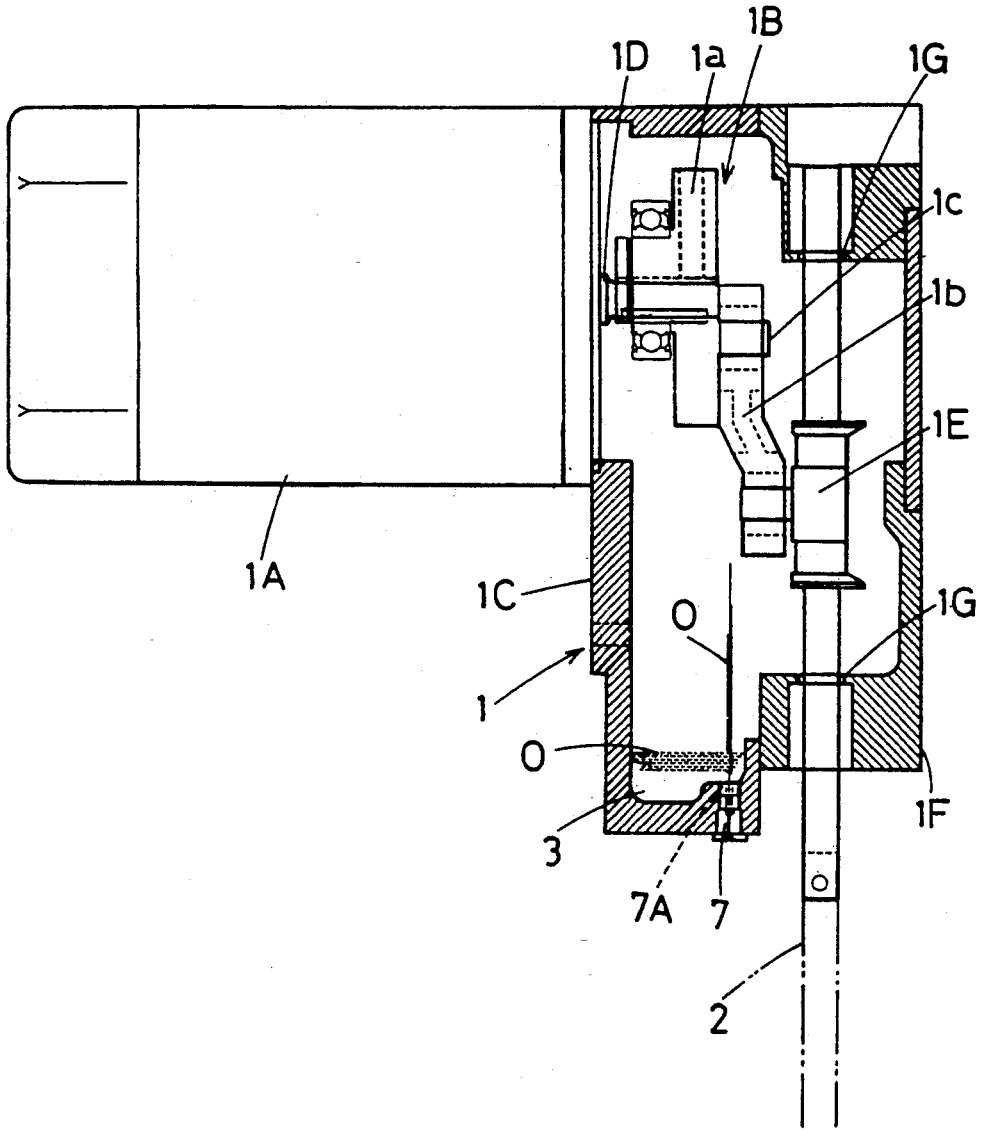
FIG. 3 is a cross-section of a side view of a cutting head in the present invention.

FIG. 2 shows a front cross-sectional view of a cutting head 1 and FIG. 3 shows a left side sectional view of the cutting head 1. In the cutting head 1, as shown in FIG. 3, a cutting blade 2 is reciprocated by a motor 1A through a cutting blade drive mechanism 1B. The cutting blade drive mechanism 1B is set within a case 1C and an eccentric disc 1*a*, which is attached to an end of a drive axis 1D, and a blade attaching bar 1E are connected by a connecting rod 1*b* of which two ends are connected to the eccentric disc 1*a* and the blade attaching bar 1E respectively by pins 1*c*, 1*c*.

Below the cutting blade drive mechanism 1B, an oil sump 3 is provided inside the case 1C.

A guide block 1F is attached in front of the case 1C. Guide holes 1G, 1G are perforated in the upper part and the lower part of the guide block 1F respectively and the blade attaching bar 1E extends through the upper and the lower guide holes 1G, 1G.

The cutting blade 2 is removably attached to the blade attaching bar 1E and extends vertically from the cutting head 1.

Guiding bar passages 1H are provided in left and right sides of the case 1C for operation of the connecting rod 1*b*.

At one side in the case 1C, a hollow space 5C is formed and a lubricating cylinder 4 is provided in the upper part inside the hollow space 5C. A piston 5B is attached to a piston rod 5A of the lubricating cylinder 4 and thereby a lubricant pump 5 is formed.

Further, a narrow path 6 is formed between the bottom portion of the hollow space 5C and oil sump 3. One end of the narrow path 6 has an opening at the hollow space 5C and a nozzle attaching perforation 61 is formed at the other end opening to the oil sump 3. A nozzle 7 is attached to the nozzle attaching perforation 61 and an opening jet 7A of the nozzle 7 is open to the oil sump 3.

A supporting body 8 is projected from a reciprocating carriage 300 which is referring to in the following paragraphs, and provided with a pair of guiding bars 8A, which are extend through the guiding bar passages 1H. At a lower portion for the supporting body 8, a base plate 8B is provided and a double acting pneumatic cylinder 9 for lifting up and down is provided on the base plate 8B. According to the in and out action of a piston rod of the cylinder 9, the cutting head 1 is lifted up and down.

Figure 1:
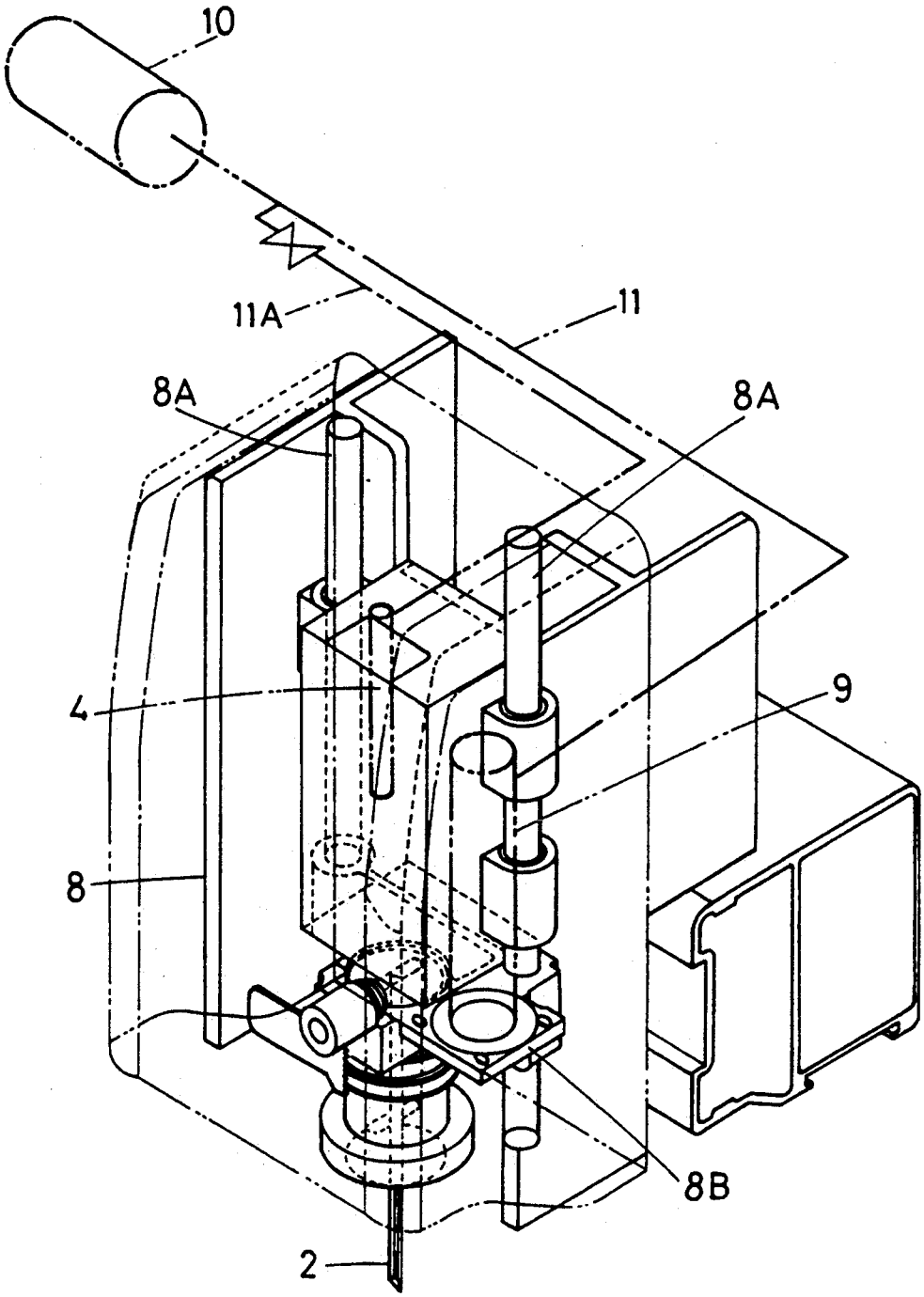
FIG. 1 is a perspective view showing a cutting head in the present invention attached to a part of a cutting machine.

A two-dot chain of thick lines in FIG. 1 show a schematic of a high-pressure air circuit. High-pressure air is supplied from a high-pressure air source 10 to the cylinder 9 through an air pipe path 11, while high-pressure air is also supplied to the lubricating cylinder 4 through an air pipe path 11A which is branched off from the air pipe path 11. In this way, when the high-pressure air is supplied from the high-pressure air source 10 to the cylinder 9, the lubricating cylinder 4 is also supplied with the high-pressure air.

When lubrication is applied to the cutting blade drive mechanism 1B, the piston rod 5A is previously drawn into the lubricating cylinder 4 so that the lubricating oil O in the oil sump 3 is drawn into the narrow path 6. Then, when cutting operation occurs, high-pressure air is supplied from the high-pressure air source 10 to the cylinder 9 for lifting up and down so that the cutting head 1 is lowered and at the same time, high-pressure air is also supplied to the lubricating cylinder 4 so that the lubricant pump 5 is actuated to jet out the lubricating oil O from the nozzle 7 to the cutting blade drive mechanism 1B.

The cylinder 9 for lifting up and down and the lubricating cylinder 4 are controlled by a control center (not shown in the figures).

Figure 4:
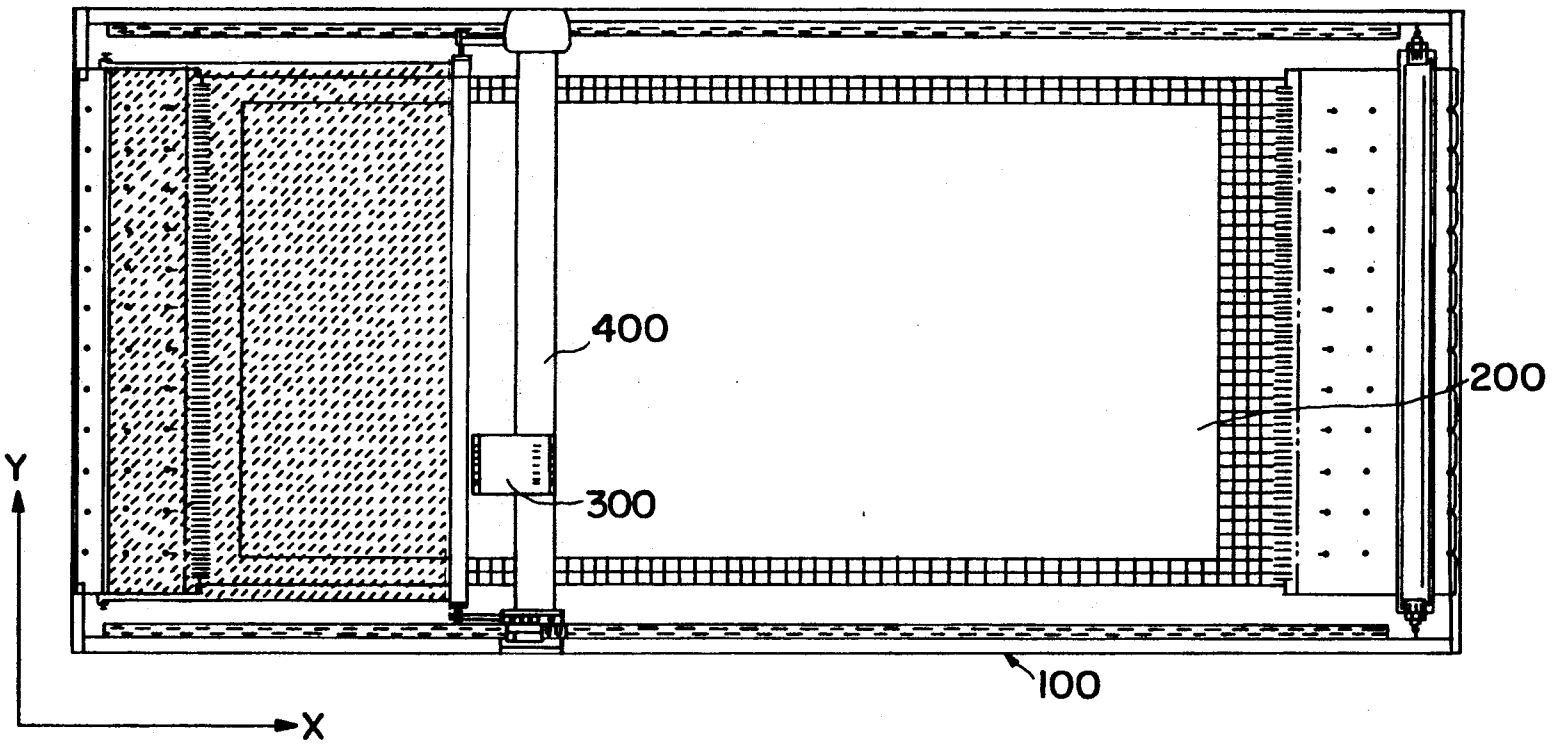
FIG. 4 is a plane view of a cutting bed of a cutting machine.

FIG. 4 shows a plane view of a cutting bed 100. The cutting head 1 is placed above a bed body 200 and supported by a carriage 300 and a carriage 400.

The carriage 400 is set to slide in a X-direction above the bed body 200 and the carriage 300 attached to the carriage 400 is set to slide in a Y-direction. Both the carriage 400 and the carriage 300 are actuated by drive control motors (not shown in the drawings) respectively controlled by a control center (not shown in the drawings).

Following is a description of actuation of the cutting machine.

The cutting head 1 is positioned in the upper position when it is not in use. When a cutting operation starts, the cutting head 1 is moved to an operating position from the non-use position by the carriages 300 and 400.

Next, the cutting head 1 is lowered by operation of the motor 1A so that the blade 2 penetrates through the pile of sheets. At this time, the lubricating oil O jets out from the nozzle 7 toward the drive mechanism 1B. This means that lubrication occurs before the cutting operation starts.

After the cutting operation, the cutting head 1 is lifted up so that the cutting blade 2 is spaced from the pile of sheets, and the cutting head 1 is moved back to the non-use position by the carriages 300 and 400.

A lubricating device proposed in the present invention may be formed so that lubrication occurs after a cutting operation. That is, the lubricating oil O jets out from the nozzle 7 toward the drive mechanism IB by actuating the pump 5 by supplying high-pressure air to the lubricating cylinder 4, while the cutting head 1 is lifted up by supplying the high-pressure air to the double acting pneumatic cylinder 9 from the high-pressure air source 10. In this case, lubrication occurs when the cutting head is lifted up and the cutting blade 2 is spaced from the pile of sheets.

Further, a lubricating device may be formed so that lubrication occurs both before and after a cutting operation. That is, when high-pressure air is supplied from the high-pressure air source 10 to the cylinder 9 for lifting up and down and the cutting head 1 is lifted up or down, the lubricating oil O jets out from the nozzle 7 toward the drive mechanism 1B by actuating the pump 5 by supplying high-pressure air to the lubricating cylinder 4. In this case, lubrication occurs both before and after a cutting operation, that is, both when the cutting head is moved downwardly and when the cutting head is lifted up.

The foregoing relates to a preferred exemplary embodiment of the invention, it being understood that other variants and embodiments thereof are possible within the spirit and scope of the invention, the latter being defined by the appended claims.

We claim:

1. An automatic lubricating device for a cutting head of a cutting machine, the cutting head being formed to be moved up and down freely by a cylinder for an up and down movement, the cutting head containing a cutting blade drive mechanism, comprising:

an oil sump provided inside the cutting head, below the cutting blade drive mechanism;

a lubricating cylinder that operates coincidently with an operation of the cylinder for up and down movement of the cutting head;

a narrow path 6 is formed in a bottom portion of said cutting head between said lubricating cylinder and said oil sump;

a pump driven by the lubricating cylinder; and a nozzle through which lubricating oil in the oil sump jets out by a pressure of the pump in which oil is directed onto the cutting blade drive mechanism, wherein the lubricating oil jets out by said pressure of the pump to the cutting blade drive mechanism when the cutting head is in a raised position.

2. An automatic lubricating device for a cutting head of a cutting mechanism as set forth in claim 1, in which said lubricating cylinder and said cylinder for moving said cutting head upwardly and downwardly is by compressed air.

3. An automatic lubricating device for a cutting head of a cutting machine, the cutting head being formed to be moved up and down freely by a cylinder for an up and down movement, the cutting head containing a cutting blade drive mechanism, comprising:

an oil sump provided inside the cutting head, below the cutting blade drive mechanism;

a lubricating cylinder that operates coincidentally with an operation of the cylinder for up and down movement of the cutting head;

a narrow path 6 is formed in a bottom portion of said cutting head between said lubricating cylinder and said oil sump;

a pump driven by the lubricating cylinder; and a nozzle through which lubricating oil in the oil sump jets out by a pressure of the pump in which oil is directed onto the cutting blade drive mechanism, wherein the lubricating oil jets out by said pressure of the pump to the cutting blade drive mechanism when the cutting head is in a downward position.

4. An automatic lubricating device for a cutting head of a cutting machine as set forth in claim 3, in which said lubricating cylinder and said cylinder for moving said cutting head upwardly and downwardly is by compressed air.

* * * * *